United States Patent [19]

Church et al.

[11] 4,254,178

[45] Mar. 3, 1981

[54] MATERIAL FOR PRODUCING A LAYERED BUILDING PANEL

[76] Inventors: Carl W. Church; Roderick C. Church; Daniel K. Church, all of 814 W. Jefferson Blvd., Mishawaka, Ind. 46544

[21] Appl. No.: 91,466

[22] Filed: Nov. 5, 1979

[51] Int. Cl.[3] ..... B32B 3/26

[52] U.S. Cl. ..... 428/310; 428/322; 428/325; 428/326; 428/525; 521/55

[58] Field of Search ..... 428/310, 315, 308, 322, 428/325, 326, 525, 528, 530, 538; 521/55, 83, 188

[56] References Cited

U.S. PATENT DOCUMENTS

| | | | |
|---|---|---|---|
| 3,745,058 | 7/1973 | Paymal | 428/310 |
| 3,878,278 | 4/1975 | Miller et al. | 521/188 |
| 3,899,455 | 8/1975 | Unlerstenhoefer et al. | 521/55 |
| 3,986,988 | 10/1976 | Sedlak et al. | 521/55 |
| 4,111,862 | 9/1978 | Geschwender | 521/55 |

FOREIGN PATENT DOCUMENTS

| | | | |
|---|---|---|---|
| 50-22493 | 3/1975 | Japan | 428/310 |

*Primary Examiner*—William J. Van Balen
*Attorney, Agent, or Firm*—Oltsch, Knoblock & Hall

[57] ABSTRACT

A building panel of a layered design with textured inner and outer layers separated by a core to form a wall unit. The inner and outer layers are composed of a mixture of urea-formaldehyde resin, water, plaster and a curing agent. The core is composed of similar materials with an insulation material added.

19 Claims, 2 Drawing Figures

MATERIAL FOR PRODUCING A LAYERED BUILDING PANEL

SUMMARY OF THE INVENTION

This invention relates to a multi-layered panel used for building.

The production of building panels has followed many variations. The types of materials used have also been varied. Generally, the panels have been utilized as a siding, having an outer face mounted upon a backing of some sort. If a textured facing was desired, concrete was utilized. However this produced structural problems. While the concrete had the desired wear resistance, it did not possess sufficient structural strength when used in thin sheets. The concrete also required a long curing time and had poor insulative properties.

The present invention is a panel constructed of a moisture and wear resistant material that can be combined with an insulative core to form a building panel or wall unit. The weight-strength problem is solved by using plaster and a urea-formaldehyde resin to increase in layer strength and reduce the weight. Insulation is provided by the addition of an insulative inner core. The versatility of invention is increased by having two textured faces, thereby enabling it to comprise an entire wall unit. Individual panels can be bonded to each other with an adhesive to form a large single piece and to facilitate building construction. The panel can also have one outer layer removed to form a siding panel.

Accordingly, it is an object of this invention to provide a building panel that includes an inner layer, an outer layer, and an insulative core sandwiched between the layers.

Another object of this invention is to provide a high strength, low weight building panel.

Still another object of this invention is to provide an economical and high quality material from which to produce building panels.

A further object of this invention is to provide a building panel that includes its own insulation.

Yet another object of this invention is to provide a building panel that can be erected quickly and bonded to other like panels to form a single unit.

Other objects will become apparent upon a reading of the following description.

BREIF DESCRIPTION OF THE DRAWINGS

DESCRIPTION OF THE PREFERRED EMBODIMENTS

The preferred embodiments illustrated are not intended to be exhaustive or to be limited to the precise forms disclosed. They are chosen in order to best explain the principles of the invention and its application and practical use and to thereby enable others skilled in the art to best utilize the invention.

Figure 1:
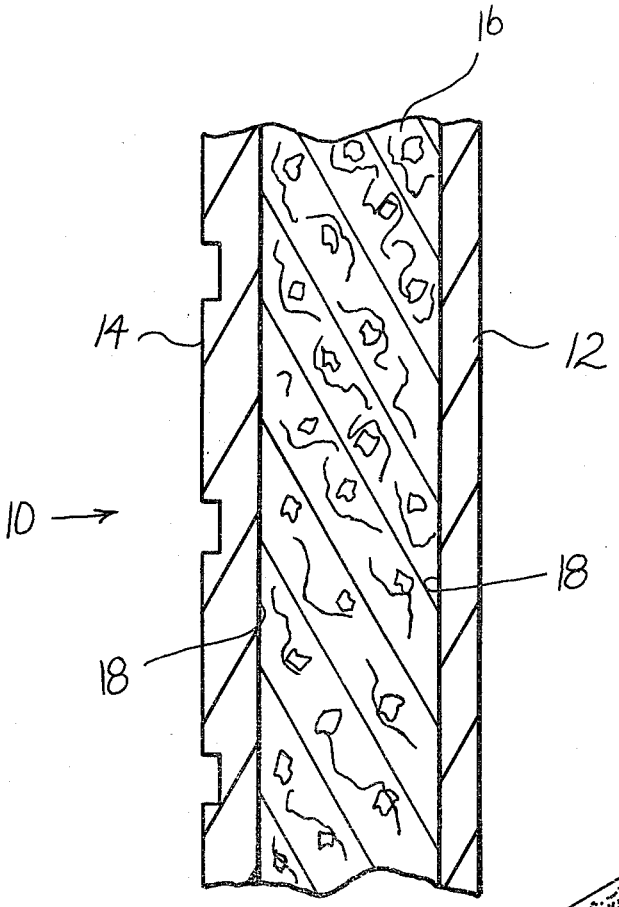
FIG. 1 is a cross-sectional view of one embodiment of the panel of this invention.
Figure 2:
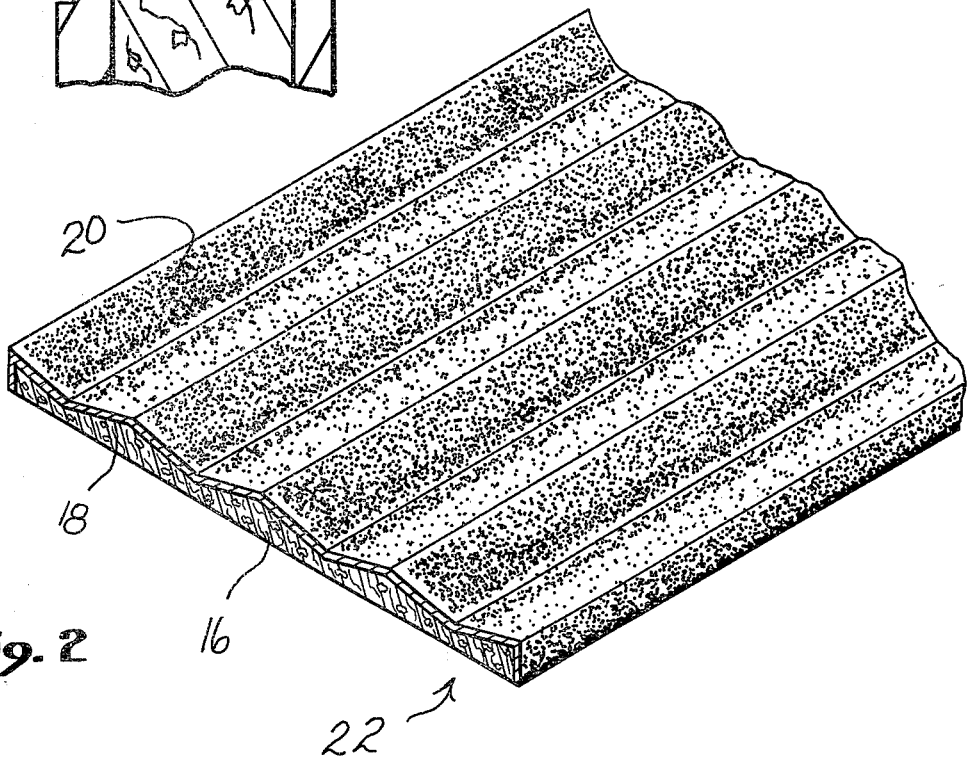
FIG. 2 is a perspective view of another embodiment of this invention.

Referring to FIG. 1, the building panel 10 is a layered sheet with an inner layer 12 and an outer layer 14 bonded to an insulative core 16. Outer layer 14 and inner layer 12 are form molded to produce textured surfaces. The building panel 22 of FIG. 2, is similar to building panel 10 of FIG. 1, except that there is only an outer layer 20. The insulative core 16 is the same as in building panel 10 with the outer surface of the panel being grooved.

In this invention, the inner and outer layer 12, 14, 20 are formed from a facing material of a mixture of a ureaformaldehyde resin, such as melamine, water, plaster, or a plaster-cement mixture, and a hydrochloric curing agent. The proportions of the components used are with the ureaformaldehyde resin being 20–25% by weight, water from 24–30% by weight, plaster being 45–55% by weight and the curing agent being 1–2% by weight.

The insulative core can be formed of styrofoam or from a mixture of the above described facing material and insulative additives. Some of the insulative additives that cana be used are glass beads, paper mache and hamermill cardboard. Such insulative additives can represent 25–50% by weight of the core with the other components of the core varying accordingly.

A preferred composition of the facing material of this invention is of the following components and proportions:

| Component | Weight | Percent |
|---|---|---|
| Melamine | 1362 g | 22.7 |
| Water | 1589 g | 26.5 |
| Plaster | 2951 g | 49.2 |
| Hydrochloric curing agent | 100 g | |
| Ammonium Chloride | 20 g | .3 |
| Water | 80 g | 1.3 |

A preferred composition of the core material of this invention is of the following components and proportions:

| Component | Weight | Percent |
|---|---|---|
| Melamine | 1362 g | 15.9 |
| Water | 1589 g | 18.5 |
| Plaster | 2951 g | 34.4 |
| Hydrochloric curing agent | 100 g | |
| Ammonium Chloride | 20 g | .2 |
| Water | 80 g | .9 |
| Insulating material | 2572 g | 30.1 |

To produce the facing material, the melamine and water are mixed together initially, with the plaster and curing agent added next. When the mixture attains a desired consistency, coloring may be added. The whole mixture is then blended with a high speed shear blender.

The core material is produced identically to the facing material except for the inclusion of the insulation additives which are introduced with the plaster and curing agent. The insulative additives may be glass beads, hammermill cardboard or paper mache. Generally, the additives comprise 30% by weight of the compound, however the amount and type may vary due to the degree of insulation desired.

To produce the building panel 10 illustrated in FIG. 1, any of the molding methods known in the art will suffice. The preferred method has facing material sprayed into molds. The interior surfaces of each mold are sprayed simultaneously each to a thickness of $\frac{3}{8}$ to $\frac{1}{2}$ inch to form inner and outer layers 12, 14 of the panel.

The core material is then sprayed into each mold over the facing material. The similarity of materials at interface 18 of panel 10 allows the materials to blend together and produce a secure bond. The core material is applied to each mold to a thickness of $1\frac{1}{2}$ to $1\frac{3}{4}$ inches.

To produce the siding panel 22 illustrated in FIG. 2, the facing material is sparyed into a mold to form outer layer or face 20 to a thickness of ½ inch. Core material is then sprayed over the facing material to a thickness of 3½ inches.

It is to be understood that the invention is not to be limited to the details above given but may be modified within the scope of the appended claims.

What I claim is:

1. A building panel comprising an inner layer and an outer layer, said inner and outer layer being formed from a facing material consisting of a mixture of urea-formaldehyde resin, water, plaster and an HCl curing agent, an insulative core material separating said inner and outer layers.

2. The panel of claim 1 wherein said facing material is composed by weight of:

| | |
|---|---|
| Urea-Formaldehyde resin | 20–25% |
| Water | 24–30% |
| Plaster | 45–55% |
| HCl curing agent | 1–2% |

3. The panel of claim 2 wherein said facing material is composed by weight of:

| | |
|---|---|
| Urea-Formaldehyde resin | 22.7% |
| Water | 26.5% |
| Plaster | 49.2% |
| HCl curing agent | 1.6% |

4. The panel of claim 1 wherein said core material is composed of a urea-formaldehyde resin, water, plaster, an HCl curing agent and an insulating material.

5. The panel of claim 4 wherein said insulating material is one of a group of insulators consisting of paper mache, hammermill cardboard and glass beads.

6. The panel of claim 5 wherein said core material is composed by weight of:

| | |
|---|---|
| Urea-Formaldehyde resin | 11–18% |
| Water | 13–20% |
| Plaster | 24–38% |
| HCl curing agent | .5–1.5% |
| Insulating material | 25–50% |

7. The panel of claim 6 wherein said core material is composed of:

| | |
|---|---|
| Urea-Formaldehyde | 15.9% |
| Water | 18.5% |
| Plaster | 34.4% |
| HCl curing agent | 1.2% |
| Insulating material | 30% |

8. The panel of claim 1 wherein one of said inner layer and said outer layer has an external facing, said facing having a textured surface.

9. The panel of claim 1 wherein said inner and outer layers have an external facing, said facing having a textured surface.

10. The panel of claim 1 wherein said core material is of a styrofoam composition.

11. A building panel having an outer face and an insulative inner layer at said outer face, said outer face being formed from a facing material which is a mixture of urea-formaldehyde resin, water, plaster, and an HCl curing agent.

12. The panel of claim 11 wherein said facing material is composed by volume of:

| | |
|---|---|
| Urea-Formaldehyde resin | 20–25% |
| Water | 24–30% |
| Plaster | 45–55% |
| HCl curing agent | 1–2% |

13. The panel of claim 11 wherein said inner layer is composed of urea-formaldehyde resin, water, plaster, an HCl curing agent and an insulating material.

14. The panel of claim 13 wherein said insulating material is one of a group of insulators consisting of paper mache, hammermill cardboard and glass beads.

15. The panel of claim 14 wherein said inner layer material is composed by weight of:

| | |
|---|---|
| Urea-Formaldehyde resin | 11–18% |
| Water | 13–20% |
| Plaster | 24–38% |
| HCl curing agent | .5–1.5% |
| Insulation material | 25–50% |

16. The panel of claim 12 wherein said facing material is composed by weight of:

| | |
|---|---|
| Urea-Formaldehyde resin | 22.7% |
| Water | 26.5% |
| Plaster | 49.2% |
| HCl curing agent | 1.6% |

17. The panel of claim 15 wherein said inner layer is composed by weight of:

| | |
|---|---|
| Urea-Formaldehyde | 15.9% |
| Water | 18.6% |
| Plaster | 34.4% |
| HCl curing agent | 1.1% |
| Insulating material | 30% |

18. The panel of claim 11 wherein said outer face has a textured surface.

19. The panel of claim 11 wherein said inner layer material is of a styrofoam composition.

* * * * *